US008585241B2

(12) United States Patent
Tsai

(10) Patent No.: US 8,585,241 B2
(45) Date of Patent: Nov. 19, 2013

(54) POWER-SAVING LIGHTING APPARATUS

(75) Inventor: Wen-Kuei Tsai, Taipei County (TW)

(73) Assignee: Chang Wah Electromaterials Inc., New Taipei (TW)

( * ) Notice: Subject to any disclaimer, the term of this patent is extended or adjusted under 35 U.S.C. 154(b) by 413 days.

(21) Appl. No.: 12/481,538

(22) Filed: Jun. 9, 2009

(65) Prior Publication Data

US 2010/0182789 A1 Jul. 22, 2010

Related U.S. Application Data

(60) Provisional application No. 61/060,798, filed on Jun. 11, 2008.

(51) Int. Cl.
*F21S 4/00* (2006.01)
*F21V 21/00* (2006.01)

(52) U.S. Cl.
USPC ..... 362/249.02; 362/362; 362/217.11; 362/217.1; 362/217.01; 362/217.05; 362/254; 362/217.06; 362/217.14; 362/249.01; 362/217.16; 362/249.06; 362/365; 362/368; 362/375; 362/234; 362/235; 362/249.11; 362/247; 362/296.01

(58) Field of Classification Search
USPC ..... 362/234, 235, 249.01, 249.11, 296.01, 362/362, 217.1, 217.01, 217.05, 217.06, 362/217.11, 217.16, 217.14, 249.02, 362/249.06, 254, 247, 365, 368, 375
See application file for complete search history.

(56) References Cited

U.S. PATENT DOCUMENTS

| | | | | |
|---|---|---|---|---|
| 3,748,460 | A * | 7/1973 | Price | 362/347 |
| 5,882,105 | A * | 3/1999 | Barlow | 362/646 |
| 6,102,550 | A * | 8/2000 | Edwards, Jr. | 362/221 |
| 6,210,025 | B1 * | 4/2001 | Schmidt et al. | 362/362 |
| 6,793,368 | B2 * | 9/2004 | Ladstatter | 362/221 |
| 7,066,617 | B2 * | 6/2006 | Mandy et al. | 362/147 |
| 7,290,911 | B2 * | 11/2007 | Tsukamoto et al. | 362/543 |
| 7,635,198 | B2 * | 12/2009 | Mayfield et al. | 362/220 |
| 7,686,470 | B2 * | 3/2010 | Chiang | 362/147 |
| 7,766,511 | B2 * | 8/2010 | Zampini et al. | 362/294 |
| 7,794,115 | B2 * | 9/2010 | Hellinger et al. | 362/294 |
| 8,066,407 | B2 * | 11/2011 | Remus et al. | 362/249.02 |
| 2006/0098441 | A1 * | 5/2006 | Chou | 362/294 |
| 2008/0084693 | A1 * | 4/2008 | Shimada et al. | 362/240 |
| 2008/0089069 | A1 * | 4/2008 | Medendorp | 362/294 |
| 2009/0213587 | A1 * | 8/2009 | Enomoto et al. | 362/235 |

* cited by examiner

*Primary Examiner* — Robert May
*Assistant Examiner* — Tsion Tumebo
(74) *Attorney, Agent, or Firm* — Muncy, Geissler, Olds & Lowe, PLLC

(57) ABSTRACT

A power-saving lighting apparatus including an upper housing, a bottom cover assembled with the upper housing, a lighting module and a positioning member is provided. The lighting module is disposed between the upper housing and the bottom cover, and the lighting module is mechanically supported by the bottom cover. The positioning member is disposed on the lighting module, wherein a relative position of the lighting module and the bottom cover is maintained by the positioning member.

14 Claims, 5 Drawing Sheets

POWER-SAVING LIGHTING APPARATUS

CROSS-REFERENCE TO RELATED APPLICATION

This application claims the priority benefit of U.S.A. provisional application Ser. No. 61/060,798, filed on Jun. 11, 2008. The entirety of the above-mentioned patent application is hereby incorporated by reference herein and made a part of specification.

BACKGROUND OF THE INVENTION

1. Field of the Invention

The present invention generally relates to a power-saving lighting apparatus, in particular, relates to a T-bar lighting apparatus having a substituted lighting module.

2. Description of Related Art

The LED chips are semiconductor devices mainly made of a compound semiconductor material containing III-V group chemical elements, for example, GaP, GaAs, and the like, and function on the principle of converting electric energy to light. That is to say, the compound semiconductor is powered to release excessive energy through the combination of electrons and holes, so as to emit photon (light). The LED can emit light without being heated too much. Therefore, the lifespan of the LED is usually up to 100,000 hours, and an idling time is not required. In addition, the LED has advantages of quick response (approximately $10^{-9}$ seconds), small volume, power-saving, low pollution, high reliability, and ease mass production. Thus, the LEDs have been intensively used in many fields, for example, light source and illumination device in large-scale bulletin boards, traffic lights, cellular phones, scanners, fax machines, office lightings, etc.

Currently, the brightness and light emitting efficiency of the LEDs are continuously improved, and meanwhile the white LEDs are successfully put into mass production, so the LEDs have been gradually used for illumination purpose, and LED lamps (e.g. bulbs, street lamps, flash lights, office lightings, etc.) have been developed rapidly.

In most offices, the T-bar lighting apparatuses having a plurality of fluorescent tubes are commonly used. FIG. 1 schematically illustrates a cross-sectional view of a conventional T-bar lighting apparatus. Referring to FIG. 1, the conventional T-bar lighting apparatus 100 includes an upper housing 110, a bottom cover 120, a plurality of lamp holders 130, a plurality of fluorescent tubes 140, a ballast unit 150, a connector 160, and a plurality of leaf springs 170. The bottom cover 120 is assembled with the upper housing 110 through the leaf springs 170 installed on the upper housing 110. The lamp holders 130 are installed on a surface of the upper housing 110 and electrically connected with the ballast unit 150 and the connector 160. As shown in FIG. 1, the fluorescent tubes 140 are assembled with and electrically connected with the lamp holders 130 such that the fluorescent tubes 140 are located between the upper housing 110 and the bottom cover 120. Specifically, the bottom cover 120 includes a plurality of reflectors 122 for reflecting the light emitted from the fluorescent tubes 140 and a plurality of partitions 124 assembled with the reflectors 122.

Since the power-consumption of the conventional T-bar lighting apparatus 100 having the fluorescent tubes 140 is quite high, many users have tendency to use the lighting module to substitute the fluorescent tubes 140. However, the installation of the substituted lighting module wastes lots of time and is expensive. An easy and cost-effective solution for installing the lighting module is required.

SUMMARY OF THE INVENTION

Accordingly, the present invention is directed to a power-saving lighting apparatus having a lighting module.

As embodied and broadly described herein, the present invention is directed to provide a power-saving lighting apparatus. The power-saving lighting apparatus includes an upper housing, a bottom cover assembled with the upper housing, a lighting module and a positioning member. The lighting module is disposed between the upper housing and the bottom cover, and the lighting module is mechanically supported by the bottom cover. The positioning member is disposed on the lighting module, wherein a relative position of the lighting module and the bottom cover is maintained by the positioning member.

According to an embodiment of the present invention, the upper housing and the bottom cover constitute a casing of a T-bar lighting apparatus.

According to an embodiment of the present invention, the bottom cover comprises a frame, a plurality of reflectors assembled with the frame and a plurality partitions assembled with the reflectors and the frame, wherein the lighting module is mechanically supported by the reflectors.

According to an embodiment of the present invention, the power-saving lighting apparatus further comprises a plurality of leaf springs assembled with the upper housing, wherein the bottom cover is assembled with the upper housing through the leaf springs.

According to an embodiment of the present invention, the power-saving lighting apparatus further comprises a plurality of dummy lamp holders disposed on the upper housing and a power supply unit electrically connected with the dummy lamp holders.

According to an embodiment of the present invention, the power supply unit comprises a dummy ballast unit disposed on the upper housing and a connector disposed on the upper housing, wherein the dummy ballast unit is electrically connected between the dummy lamp holders and the connector.

According to an embodiment of the present invention, the power-saving lighting apparatus further comprises a first fixing member connected between the upper housing and the bottom cover, wherein the bottom cover is capable of hanging under the upper housing through the first fixing member.

According to an embodiment of the present invention, the power-saving lighting apparatus further comprises a second fixing member connected between the upper housing and the lighting module, wherein the lighting module is capable of hanging under the upper housing through the second fixing member.

According to an embodiment of the present invention, the lighting module comprises a circuit board, a light-emitting-diode (LED) light source and an optical film disposed on the circuit board, wherein the LED light source is disposed on and electrically connected with the circuit board, the LED light source is located between the circuit board and the optical film, and the positioning member is disposed on the optical film.

According to an embodiment of the present invention, the circuit board comprises a metal-core printed circuit board (MCPCB).

According to an embodiment of the present invention, the optical film comprises a diffusion plate or a prism plate.

According to an embodiment of the present invention, the lighting module further comprises a heat sink disposed on the circuit board, such that the heat sink and the LED light source are disposed at two opposite side of the circuit substrate.

According to an embodiment of the present invention, the lighting module further comprises a connecting member adhered between the circuit board and the optical film.

According to an embodiment of the present invention, the lighting module further comprises a heat sink disposed between the circuit board and the optical film, and the heat sink has a light-transmitting opening corresponding to the LED light source.

According to an embodiment of the present invention, the lighting module further comprises a first connecting member adhered between the circuit board and the heat sink and a second connecting member adhered between the heat sink and the optical film.

According to an embodiment of the present invention, the lighting module is mechanically supported by the bottom cover to contact with the upper housing.

According to an embodiment of the present invention, the lighting module comprises an organic light-emitting diode (OLED) module or a module having at least one cold cathode fluorescent lamps disposed thereon.

Since the lighting module is mechanically supported by the bottom cover, the installation and replacement of the lighting module is simple and cost-effective.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
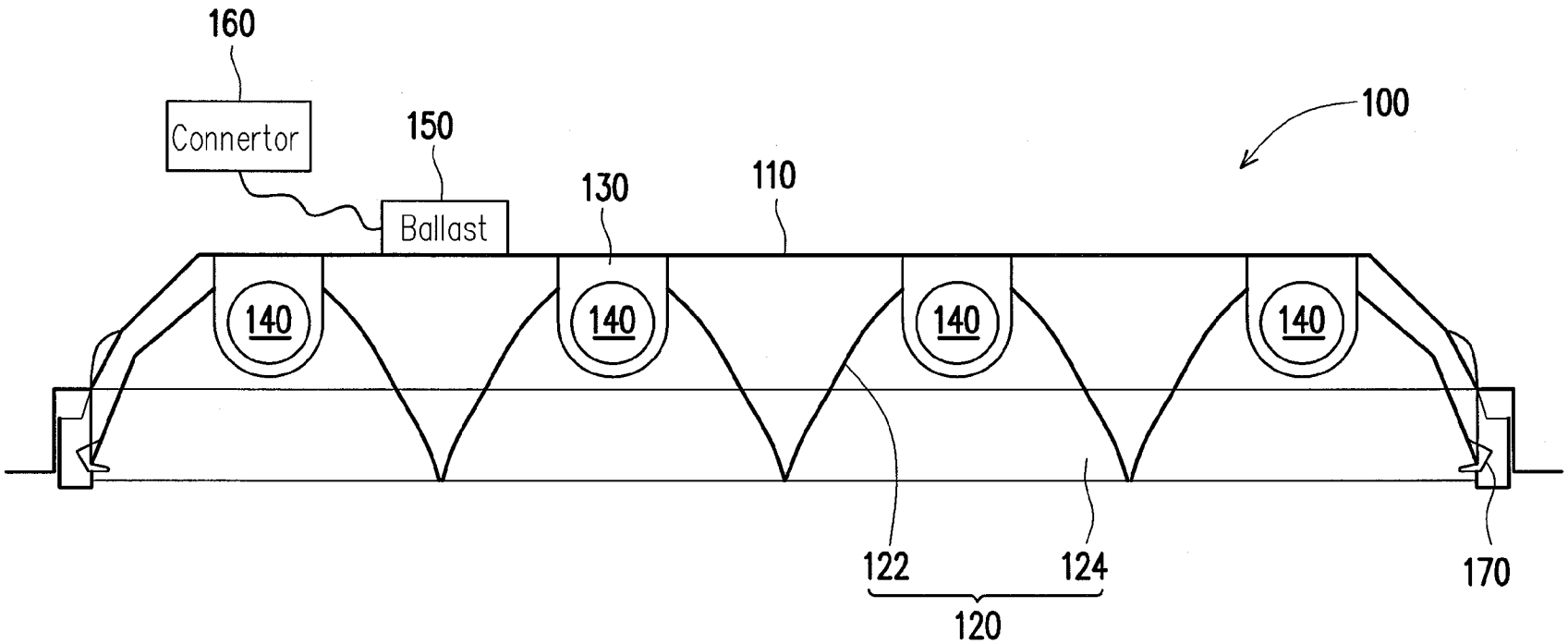
FIG. 1 schematically illustrates a cross-sectional view of a conventional T-bar lighting apparatus.

Reference will now be made in detail to the present preferred embodiments of the invention, examples of which are illustrated in the accompanying drawings. Wherever possible, the same reference numbers are used in the drawings and the description to refer to the same or like parts.

In order to save the electrical power, the present invention provides a lighting module capable of being integrated with the conventional T-bar lighting apparatus 100 as shown in FIG. 1, such that the lighting module of the present invention can, substitute the currently used fluorescent tubes 140 immediately. The installation of the lighting module of an embodiment of the present invention is illustrated as followings.

Figure 2:
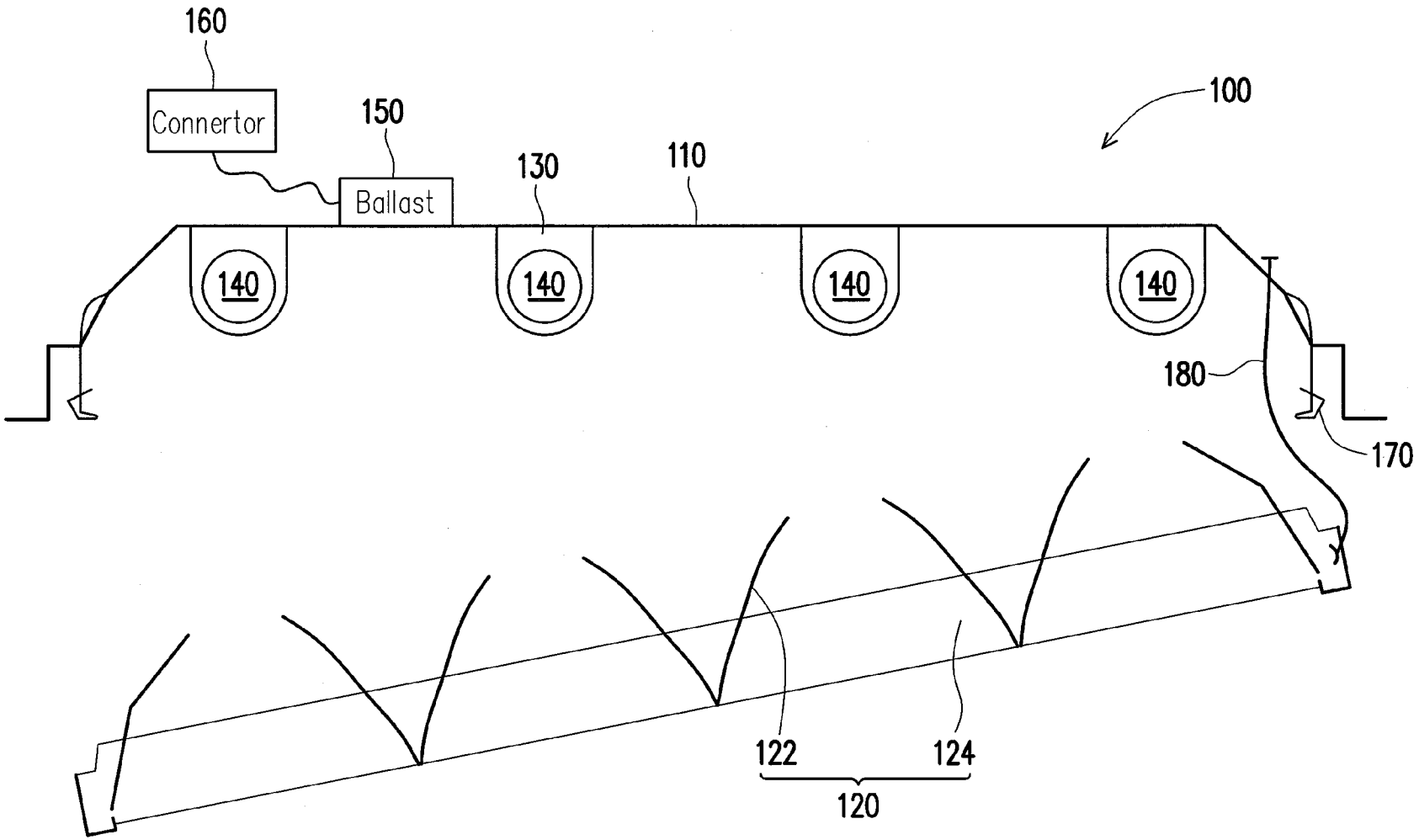
FIGS. 2-4 schematically illustrate installation of a lighting module onto a T-bar lighting apparatus in accordance with an embodiment of the present invention.
Figure 3:
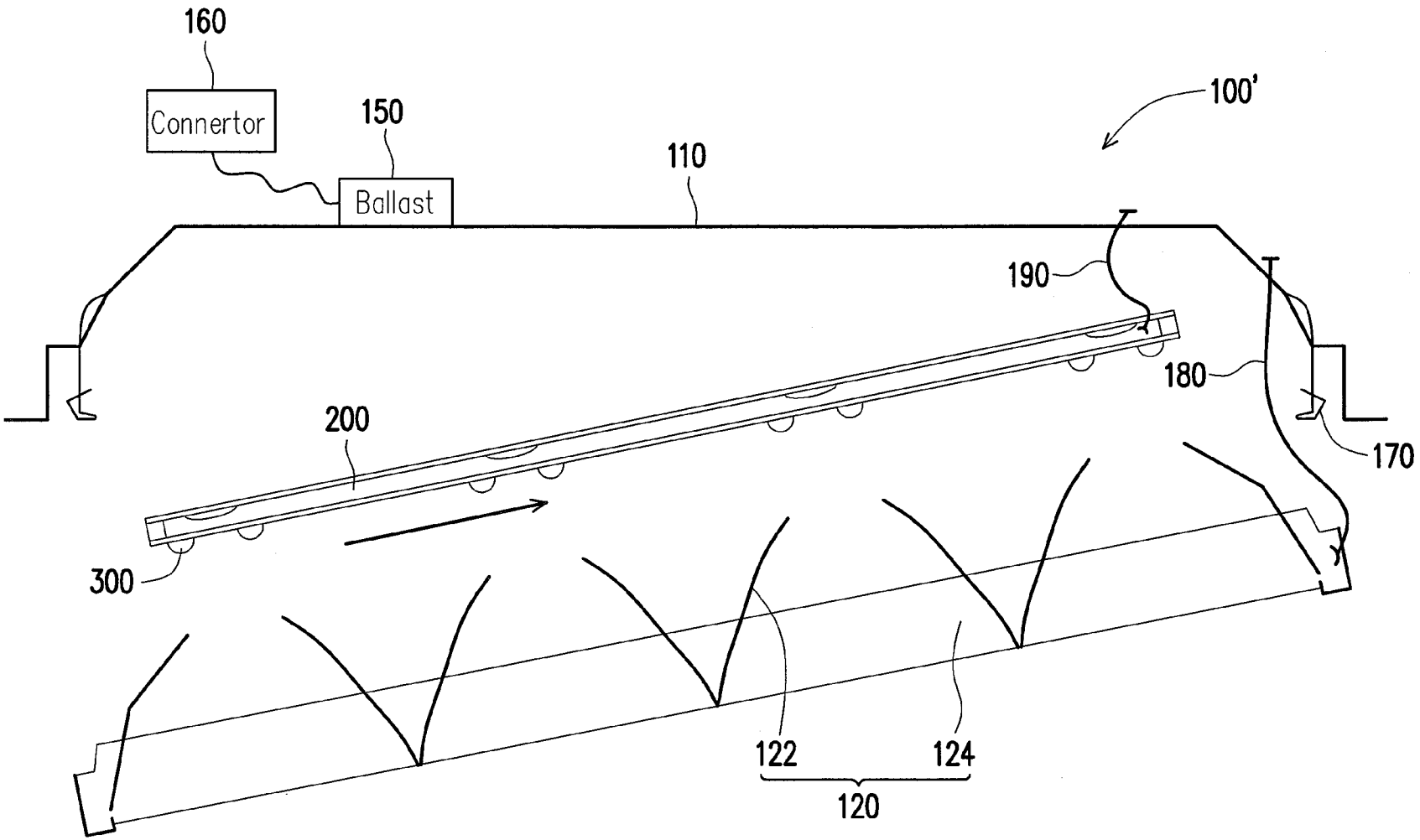
Figure 4:
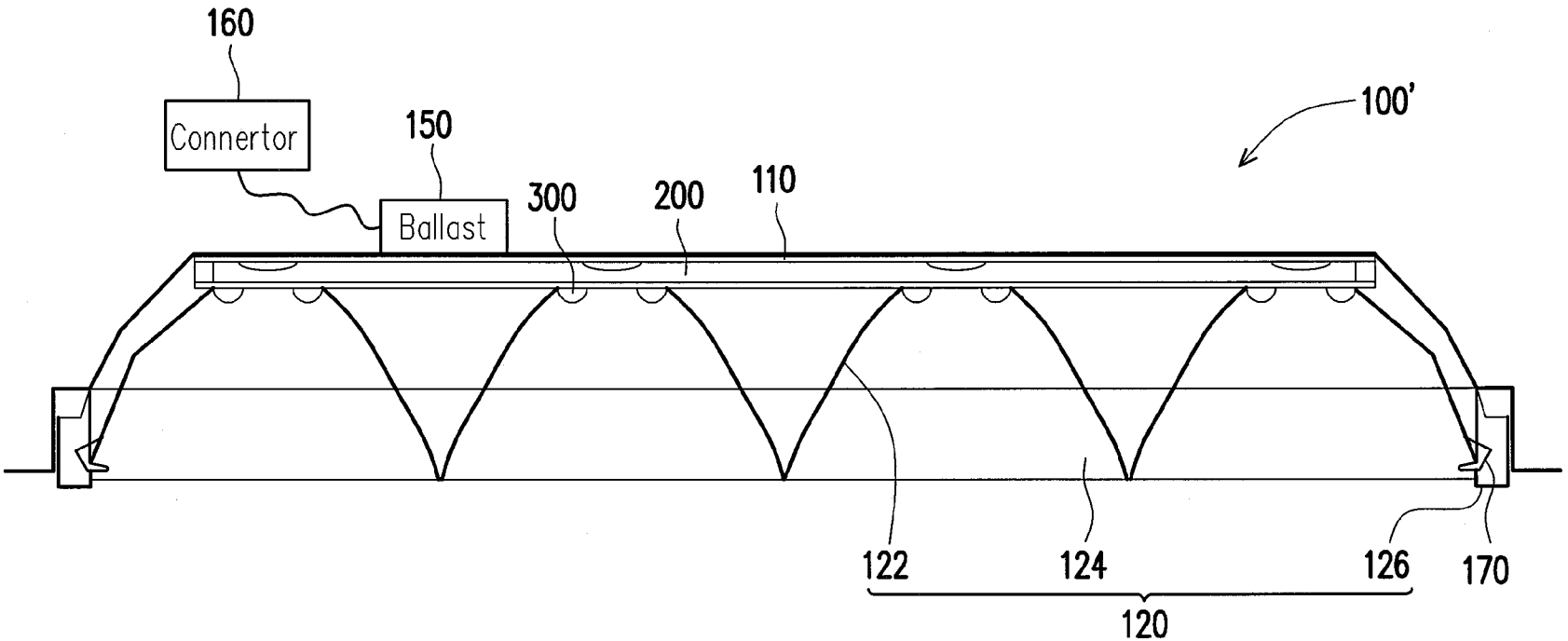

FIGS. 2-4 schematically illustrate installation of a lighting module onto a T-bar lighting apparatus in accordance with an embodiment of the present invention. Referring to FIG. 2, users may push the leaf spring 170 to dismantle the bottom cover 120 from the upper housing 110 so as to unload the fluorescent tubes 140 assembled with the lamp holders 130. After the bottom cover 120 is dismantled from the upper housing 110, the bottom cover 120 hangs under the upper housing 110 through a first fixing member 180 connected between the upper housing 110 and the bottom cover 120 so as to prevent the bottom cover 120 from dropping.

Referring to FIG. 3, a lighting module 200 with power-saving property is then provided to be assembled with the upper cover 110 through a second fixing member 190 connected between the upper housing 110 and the lighting module 200, such that the lighting module 200 is capable of hanging under the upper housing 110 through the second fixing member 190. The first fixing member 180 and the second fixing member 190 may be a rope made of insulating materials, such as polymer, textile, etc. In the present embodiment, the lighting module 200 may be at least one LED light bars, at least one LED plane light source, at least one organic light-emitting diode (OLED) light bars, at least one OLED plane light source, a lighting module having cold cathode fluorescent lamps (CCFLs) installed thereon, or other types of lighting modules. For example, the OLED may be a Phosphorescent OLED (PHOLED or a white OLED (WOLED) provided by Universal Display Corporation. When the fluorescent tubes 140 are unloaded, the lamp holders 130 and the ballast unit 150 for driving the fluorescent tubes 140 is useless for driving the lighting module and become dummy components. Specifically, in the power-saving lighting apparatus 100' having the lighting module 200, a plurality of dummy lamp holders 130 and dummy ballast unit 150 are still disposed on the upper cover 110. It is noted that, the dummy lamp holders 130 and the dummy ballast unit 150 used for driving the fluorescent tubes may be further dismantled optionally. In an alternate embodiment of the invention, the lighting module 200 may be electrically connected to the dummy lamp holders 130 through an electrical wire or other suitable means for electrical connection. More specifically, the lighting module 200 may be electrically connected to the dummy lamp holders 130 through an electrical wire and a power adapter. The power adapter may be a component mounted on the lighting module 200 or may be fabricated in a circuit board.

Referring to FIG. 4, the bottom cover 120 is assembled with the upper cover 110 through the leaf spring 170 again so as to accomplish the installation of the lighting module 200. After the installation of the lighting module 200, the lighting module 200 is mechanically supported by the bottom cover 120 stably. The lighting module 200 may further contact with the upper housing 110 such that the lighting module 200 can be sandwiched between the upper housing 110 and the bottom cover 120 firmly.

In the present embodiment, the dummy ballast unit 150 and the connector 160 of the power-saving lighting apparatus 100' may constitute a power supply, wherein the dummy ballast unit 150 is electrically connected between the dummy lamp holders 130 and the connector 160. The lighting module 200 may be electrically connected with the power line through the connector 160 originally disposed on the upper cover 110. However, the electrical connection between the lighting module 200 and the power line can be realized by any other suitable manners and one ordinary skilled in the art can choose the electrical connection manners base on different design requirements.

Referring to FIG. 4, the power-saving lighting apparatus 100' of the present invention includes an upper housing 110, a bottom cover 120 assembled with the upper housing 110, a lighting module 200 and a positioning member 300. The lighting module 200 is disposed between the upper housing 110 and the bottom cover 120, and the lighting module 200 is mechanically supported by the bottom cover 120. The positioning member 300 is disposed on the lighting module 200, wherein a relative position of the lighting module 200 and the bottom cover 120 is maintained by the positioning member 300.

In the present embodiment, the upper housing 110 and the bottom cover 120 constitute a casing of a T-bar lighting apparatus. Specifically, the bottom cover 120 may includes a frame 126, a plurality of reflectors 122 assembled with the frame 126 and a plurality partitions 124 assembled with the reflectors 122 and the frame 126, wherein the lighting module 200 is mechanically supported by the reflectors 122.

Figure 5A:
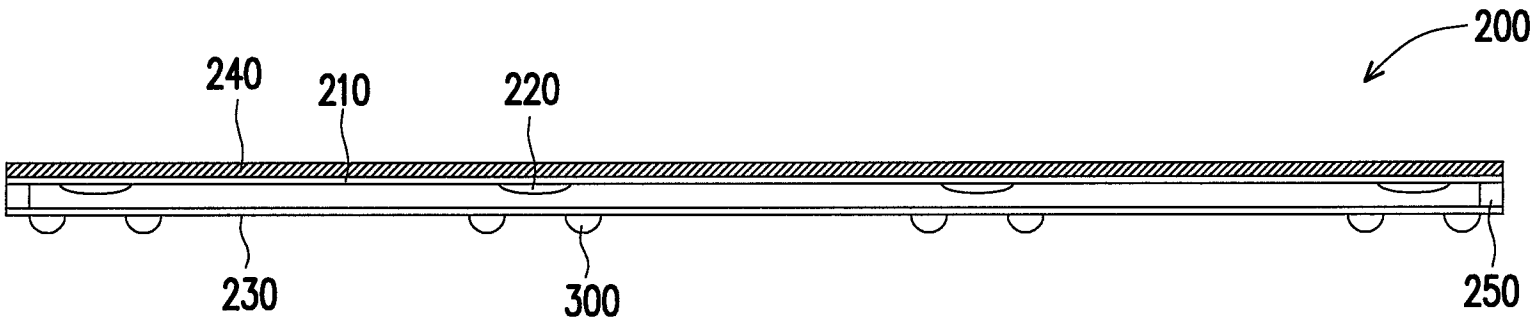
FIG. 5A and FIG. 5B illustrate cross-sectional views of two lighting modules in accordance with an embodiment of the present invention.
Figure 5B:
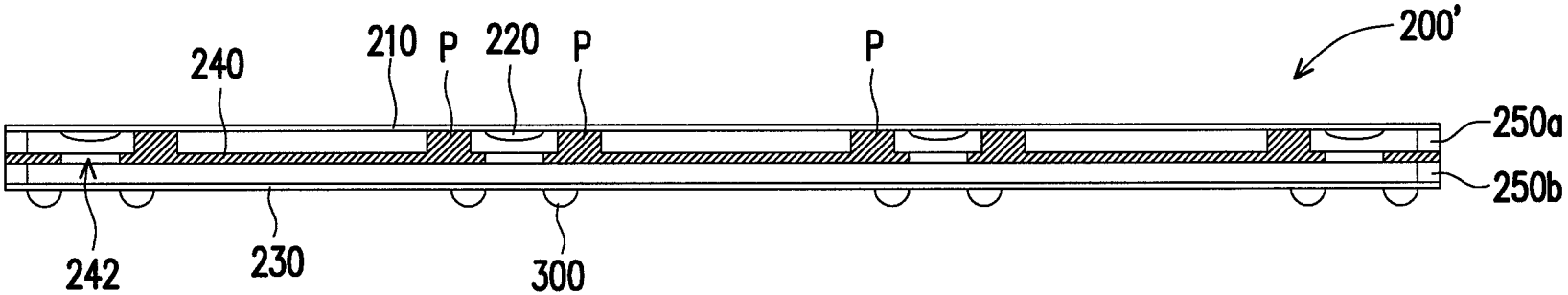

FIG. 5A and FIG. 5B illustrate cross-sectional views of two lighting modules in accordance with an embodiment of the present invention. Referring to FIG. 5A, the lighting module 200 according to an embodiment of the present invention includes a circuit board 210 (e.g. a metal-core printed circuit board), an LED light source 220 and an optical film 230 (e.g. a diffusion plate or a prism plate) disposed on the circuit board 210, wherein the LED light source 220 is disposed on and electrically connected with the circuit board 210, the LED light source 220 is located between the circuit board 210 and the optical film 230, and the positioning member 300 is disposed on the optical film 230. In detail, the positioning member 300 is disposed on an outer surface of the optical film 230 so as to maintain the relative position of the lighting module 200 and the bottom cover 120.

As shown in FIG. 5A, the lighting module 200 may further include a heat sink 240 disposed on the circuit board 210, such that the heat sink 240 and the LED light source 220 are disposed at two opposite side of the circuit substrate 210. When the lighting module 200 is disposed to contact with the upper housing 112, the heat sink 230 can contact with the upper housing 112 to enhance the overall heat dissipation performance of the lighting module 200. Additionally, the lighting module 200 may further include a connecting member 250 adhered between the circuit board 210 and the optical film 230.

More specifically, in order to enhance heat dissipation characteristics of the LED light source 220, the circuit board 210 may have a plurality through holes (not shown) while the heat sink 210 may have a plurality of protrusions (not shown) extending through the through holes and the protrusions are directly in contact with the LED light source 220. It is noted that various heat dissipation solution may be applied to the lighting module 200.

It is noted that when organic light-emitting diodes (OLED) are used as the lighting module 200, the organic light-emitting diodes (OLED) may be a flexible film-like device which is installed on the heat sink 240. For example, the organic light-emitting diodes (OLED) may be installed on the heat sink through a frame and is electrically connected with a flexible printed circuit (PFC) film. In addition, when CCFLs are used as the lighting module 200, the CCFLs maybe installed on a circuit board.

The lighting module 200' shown in FIG. 5B is similar with the lighting module 200 shown in FIG. 5A except that the heat sink 240 is disposed between the circuit board 210 and the optical film 230, and the heat sink 240 has a light-transmitting opening 242 corresponding to the LED light source 220. Additionally, the lighting module 200' may further include a first connecting member 250*a* adhered between the circuit board 210 and the heat sink 240 and a second connecting member 250*b* adhered between the heat sink 240 and the optical film 230. Specifically, in order to enhance heat dissipation characteristics of the LED light source 220, the heat sink 240 may have a plurality of protrusions P which are in contact with the circuit board 210 directly.

To sum up, the lighting module in the power-saving lighting apparatus is installed and replaced easily and quickly. Therefore, the installation and replacement of the lighting module is cost-effective.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A power-saving lighting apparatus, comprising:

a preexisting upper housing having a plurality of preexisting lamp holders;

a preexisting bottom cover arranged below the preexisting upper housing and assembled with the preexisting upper housing, the preexisting bottom cover comprising a frame, a plurality of reflectors assembled with the frame, and a plurality partitions assembled with the reflectors and the frame, wherein each of the reflectors comprises a first edge and a second edge opposite to the first edge, and the first edge is fixed on a surface of the preexisting bottom cover;

a retrofit lighting module disposed between the preexisting upper housing and the preexisting bottom cover, wherein the retrofit lighting module is electrically connected with the preexisting lamp holders through a power adapter and only mechanically supported by the second edges edge of the reflectors of the preexisting bottom cover;

a plurality of protrusions disposed on a flat surface of the retrofit lighting module, wherein the second edge of the reflectors respectively resists against the protrusions so as to bear the retrofit lighting module and push the retrofit lighting module to contact with the preexisting upper housing, such that the retrofit lighting module is fixed between the preexisting upper housing and the preexisting bottom cover, and the preexisting upper housing and the preexisting bottom cover constitute a casing of a T-bar lighting apparatus;

a preexisting rope-shaped first fixing member connecting the preexisting upper housing and the preexisting bottom cover; and a preexisting rope-shaped second fixing member connecting the preexisting upper housing and the retrofit lighting module, wherein the retrofit lighting module will be hanged from the preexisting upper housing in case the retrofit lighting module is not fixed.

2. The power-saving lighting apparatus as claimed in claim 1, further comprising a plurality of leaf springs assembled with the preexisting upper housing, wherein the preexisting bottom cover is assembled with the preexisting upper housing through the leaf springs.

3. The power-saving lighting apparatus as claimed in claim 1, further comprising a power supply unit electrically connected with the preexisting lamp holders.

4. The power-saving lighting apparatus as claimed in claim 3, wherein the power supply unit comprises:

a preexisting ballast unit disposed on the preexisting upper housing; and a preexisting connector disposed on the preexisting upper housing, wherein the preexisting ballast unit is electrically connected between the preexisting lamp holders and the preexisting connector.

5. The power-saving lighting apparatus as claimed in claim 1, wherein the retrofit lighting module comprises:

a circuit board;

a light-emitting diode (LED) light source disposed on and electrically connected with the circuit board; and an optical film disposed on the circuit board, wherein the LED light source is located between the circuit board and the optical film, and the protrusions are disposed on the optical film.

6. The power-saving lighting apparatus as claimed in claim 5, wherein the circuit board comprises a metal-core printed circuit board.

7. The power-saving lighting apparatus as claimed in claim 5, wherein the optical film comprises a diffusion plate or a prism plate.

8. The power-saving lighting apparatus as claimed in claim 5, wherein the retrofit lighting module further comprises a heat sink disposed on the circuit board, such that the heat sink and the LED light source are disposed at two opposite side of the circuit board.

9. The power-saving lighting apparatus as claimed in claim 8, wherein the retrofit lighting module further comprises a connecting member adhered between the circuit board and the optical film.

10. The power-saving lighting apparatus as claimed in claim 5, wherein the retrofit lighting module further comprises a heat sink disposed between the circuit board and the optical film, and the heat sink has a light-transmitting opening corresponding to the LED light source.

11. The power-saving lighting apparatus as claimed in claim 10, wherein the retrofit lighting module further comprises:

a first connecting member adhered between the circuit board and the heat sink; and a second connecting member adhered between the heat sink and the optical film.

12. The power-saving lighting apparatus as claimed in claim 1, wherein the retrofit lighting module comprises an organic light-emitting diode (OLED) module or a module having at least one cold cathode fluorescent lamps disposed thereon.

13. A power-saving lighting apparatus, comprising:

a preexisting upper housing;

a preexisting bottom cover arranged below the preexisting upper housing and assembled with the preexisting upper housing, the preexisting bottom cover comprising a frame, a plurality of reflectors, and a plurality partitions, wherein the frame, the reflectors, and the partitions are assembled with one another, and each of the reflectors comprises a first edge and a second edge, in which the second edge is opposite to the first edge, and the first edge is fixed on a surface of the preexisting bottom cover;

a retrofit lighting module disposed between the preexisting upper housing and the preexisting bottom cover, wherein the retrofit lighting module comprises a circuit board, a light-emitting diode (LED) light source disposed on and electrically connected with the circuit board, an optical film disposed on the circuit board, and a plurality of protrusions disposed on the optical film, and the second edge of the reflectors respectively resist against the protrusions so as to bear the retrofit lighting module and push the retrofit lighting module to contact with the preexisting upper housing, such that the retrofit lighting module is fixed between the preexisting upper housing and the preexisting bottom cover, and the preexisting upper housing and the preexisting bottom cover constitute a casing of a T-bar lighting apparatus; and a preexisting rope-shaped fixing member connecting the preexisting upper housing and the retrofit lighting module, wherein the preexisting upper housing will hang the retrofit lighting module via the preexisting rope-shaped fixing member in case the retrofit lighting module is not fixed.

14. A power-saving lighting apparatus, comprising:

a preexisting upper housing having a plurality of preexisting lamp holders;

a preexisting bottom cover arranged below the preexisting upper housing and assembled with the preexisting upper housing, the preexisting bottom cover comprising a frame, a plurality of reflectors, and a plurality partitions, wherein the frame, the reflectors, and the partitions are assembled with one another, and each of the reflectors comprises a first edge and a second edge, in which the second edge is opposite to the first edge, and the first edge is fixed on a surface of the preexisting bottom cover;

a retrofit lighting module disposed between the preexisting upper housing and the preexisting bottom cover, wherein the retrofit lighting module comprises a plurality of protrusions, a circuit board, and a light-emitting diode (LED) light source disposed on and electrically connected with the circuit board, the retrofit lighting module is electrically connected with the preexisting lamp holders through a power adapter, and the second edge of the reflectors respectively resist against the protrusions so as to bear the retrofit lighting module and push the retrofit lighting module to contact with the preexisting upper housing, such that the retrofit lighting module is fixed between the preexisting upper housing and the preexisting bottom cover, and the preexisting upper housing and the preexisting bottom cover constitute a casing of a T-bar lighting apparatus.

* * * * *